United States Patent [19]

Benroth

[11] 4,092,005

[45] May 30, 1978

[54] VEGETABLE CHOPPER

[75] Inventor: Emory E. Benroth, Bluffton, Ohio

[73] Assignee: The Raymond Lee Organization, Inc., New York, N.Y.

[21] Appl. No.: 721,678

[22] Filed: Sept. 9, 1976

[51] Int. Cl.[2] ..... B02C 18/04

[52] U.S. Cl. ..... 241/168; 83/633; 241/199.11; 241/283

[58] Field of Search ..... 241/168, 169, 169.2, 241/199.8, 199.9, 199.11, 270, 283; 30/445; 83/633, 634

[56] References Cited

U.S. PATENT DOCUMENTS

| | | | |
|---|---|---|---|
| 277,452 | 5/1883 | Brandt | 83/633 X |
| 514,236 | 2/1894 | Moonelis | 83/633 X |
| 1,491,464 | 4/1924 | Coomer | 83/633 X |
| 1,521,271 | 12/1924 | Boon | 30/445 X |

FOREIGN PATENT DOCUMENTS

| | | | |
|---|---|---|---|
| 699,182 | 5/1945 | France | 241/199.11 |
| 631,189 | 10/1949 | United Kingdom | 241/199.11 |

*Primary Examiner*—Roy Lake
*Assistant Examiner*—Howard N. Goldberg
*Attorney, Agent, or Firm*—Howard I. Podell

[57] ABSTRACT

A vegetable chopper in the form of a frame on which a knife blade is fitted to a lower end of a vertical member slidably mounted on the frame. A lever arm, pivotably mounted to the frame is shaped with a slot in which a pin, fixed to the slidable vertical member travels. Manual pivoting of the lever causes the vertical member to move in a linear direction to cause the knife blade to reciprocate with regard to a chopping box, mounted on the base of the frame.

1 Claim, 3 Drawing Figures

VEGETABLE CHOPPER

SUMMARY OF THE INVENTION

My invention is a vegetable chopper in the form of a frame on which a knife blade is fitted to a lower end of a vertical member slidably mounted on the frame. A lever arm, pivotably mounted to the frame is shaped with a slot in which a pin, fixed to the slidable vertical member travels. Manual pivoting of the lever causes the vertical member to move in a linear direction to cause the knife blade to reciprocate with regard to a chopping box, mounted on the base of the frame.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
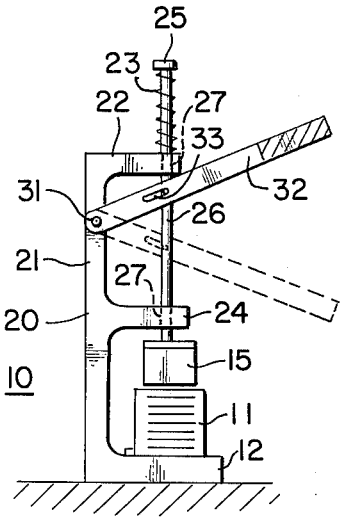
FIG. 1 is a scale view of the invention.
Figure 2:
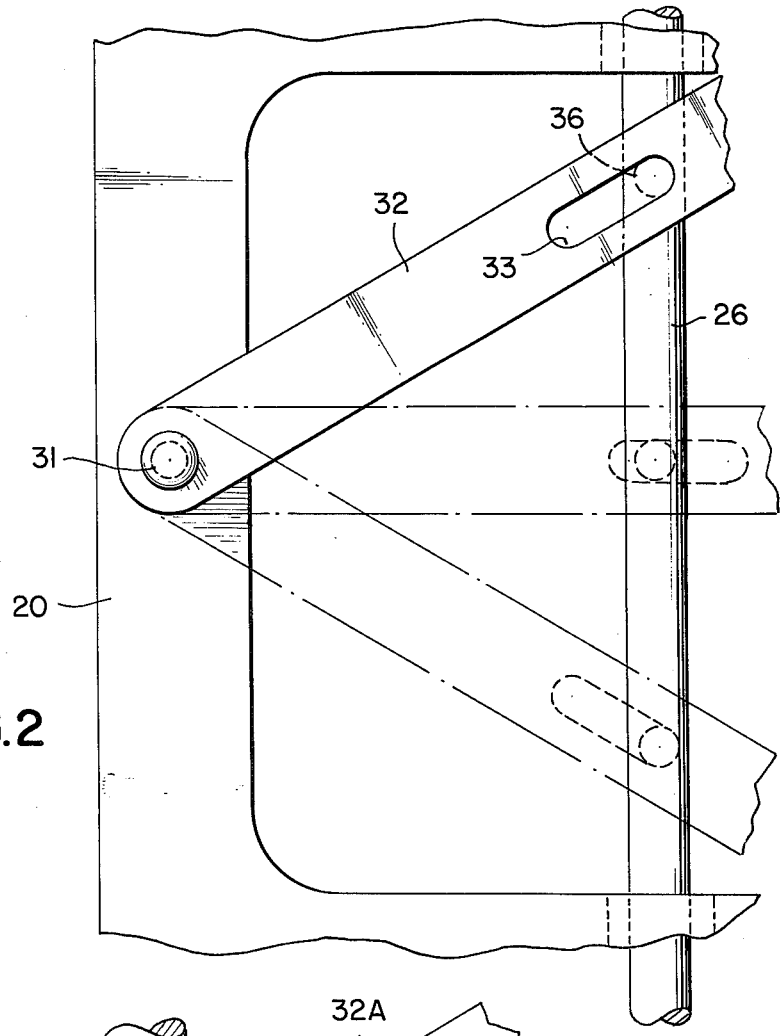
FIG. 2 is a detail scale view of the invention.

Turning now descriptively to the drawings, in which similar reference characters denote similar elements throughout the several views, FIGS. 1–2 illustrate the vegetable chopper machine 10. A slotted chopping box 11 rests on the base 12 of the machine 10 and encloses vegetables to be chopped by the knife blade 15, which is of a size to freely pass through a slot in the box 11.

Frame 20 is formed of an upright member 21 fixed to the base 12 and to a pair of spaced parallel arms 22 and 24. The knife blade 12 is fixed to a vertical rod 26 slidably mounted in holes 27 in arms 22 and 24, with rod 26 extending above the upper arm 22 to terminate in a knob 25. A coil spring 23 is mounted about rod 26 bearing against knob 25 and upper arm 22 so as to bias rod 26 upwards.

A lever 32 is pivotably mounted to upright member 21 by a rivet 31. A slot 33 in lever 32 engages a pin 36 extending laterally from rod 26 so that pivoting of lever 32 serves to move rod 26 in the axial direction, as shown by the dotted lines of FIG. 2.

Figure 3:
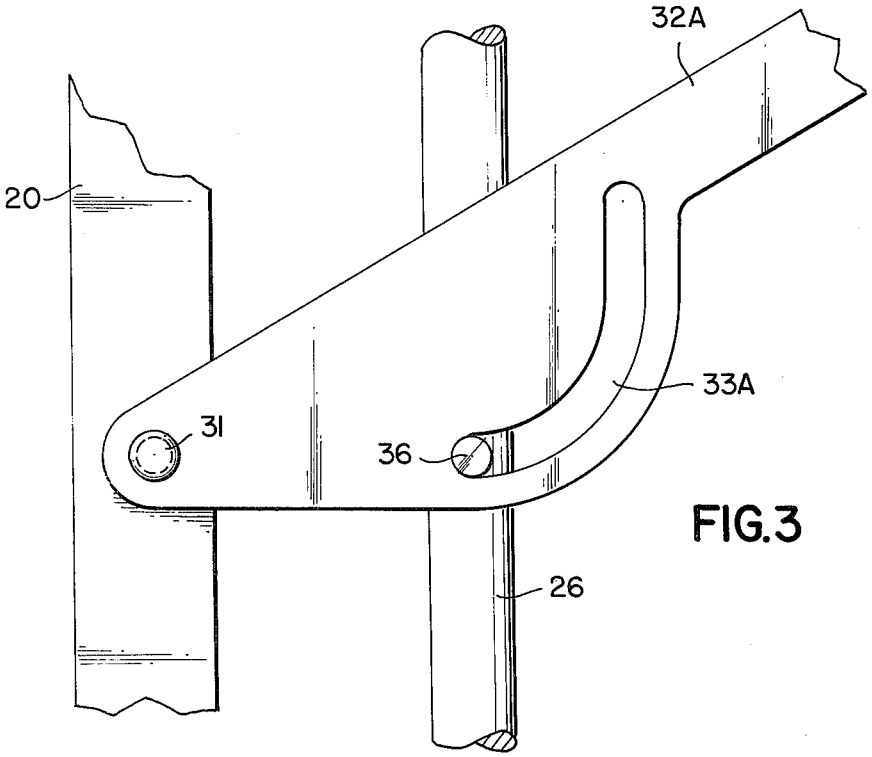
FIG. 3 is a detail scale view of an alternate embodiment.

Slot 33 may be shaped along a straight axis as shown in FIG. 2 or alternately slot 33A of a lever 32A may be shaped along an arcurate axis as shown in FIG. 3 to provide for a non-uniform motion of rod 26 in response to manual pivotal travel of lever 32A.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A vegetable chopper, comprising a frame formed of a upright member fixed to a base and to a pair of spaced parallel arms, a rod slidably mounted to said parallel arms and extending beyond both arms, a knife blade fixed to one end of the said rod, a lever pivotably mounted to said upright member of the frame, said lever linked by slotted means to said rod, said slotted means comprising a curved slot in the lever, in which slot extends a pin fixed to the said rod, so that pivotal travel of the lever causes said rod to travel in non-uniform relation to the travel of the lever.

* * * * *